US008009106B2

(12) United States Patent
Yang et al.

(10) Patent No.: US 8,009,106 B2
(45) Date of Patent: Aug. 30, 2011

(54) DUAL FREQUENCY ANTENNA AND COMMUNICATION SYSTEM

(75) Inventors: Chih-Yuan Yang, Taipei Hsien (TW); Po-Wei Kuo, Taipei Hsien (TW); Suo-Bing Su, Taipei Hsien (TW); Hung-Chang Ko, Taipei Hsien (TW); Wen-Chun Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 361 days.

(21) Appl. No.: 12/423,016

(22) Filed: Apr. 14, 2009

(65) Prior Publication Data

US 2009/0256756 A1 Oct. 15, 2009

(30) Foreign Application Priority Data

Apr. 14, 2008 (CN) ..... 2008 1 0301132

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,788,257 B2 9/2004 Fang et al.
7,079,079 B2 * 7/2006 Jo et al. ..... 343/700 MS

* cited by examiner

*Primary Examiner* — Hoang V Nguyen
(74) *Attorney, Agent, or Firm* — Altis Law Group, Inc.

(57) ABSTRACT

A dual frequency antenna includes a first scythe-shaped arm and a second scythe-shaped arm. The first scythe-shaped arm is configured for operating in a first band. The second scythe-shaped arm is configured for operating in a second band and includes an inverted-T-shaped strip with a foot of the inverted-T-shaped strip connected to the second scythe-shaped arm. The first scythe-shaped arm is attached to the second scythe-shaped arm at an apex. A head of the inverted-T-shaped strip is closer to the apex than the foot. A communication system is also provided.

20 Claims, 4 Drawing Sheets

DUAL FREQUENCY ANTENNA AND COMMUNICATION SYSTEM

BACKGROUND

1. Technical Field

The present disclosure relates to antennas, and particularly to a dual frequency antenna and a communication system using the same.

2. Description of Related Art

Most wireless devices allows one communication mode. For example, a Bluetooth® device may be used to enable communications to other Bluetooth® devices, a wireless local area network (WLAN) may be used to communicate with other WLAN devices or a home radio frequency (HomeRF) device is used to communicate with other HomeRF devices. Having one wireless device with more than one communication mode will, obviously, be very desirable. However, one of the problems of having one wireless device being used for different wireless communication mode is that the frequency of transmission used in each mode may differ. An important parameter for using different frequency is that the antenna or antennas must be capable of operating in the different frequencies. Using more than one antenna will increase the cost and complexities of the wireless device.

Therefore, a dual frequency antenna and a communication system using the same are needed in the industry to address the aforementioned deficiency.

DETAILED DESCRIPTION

Figure 1:
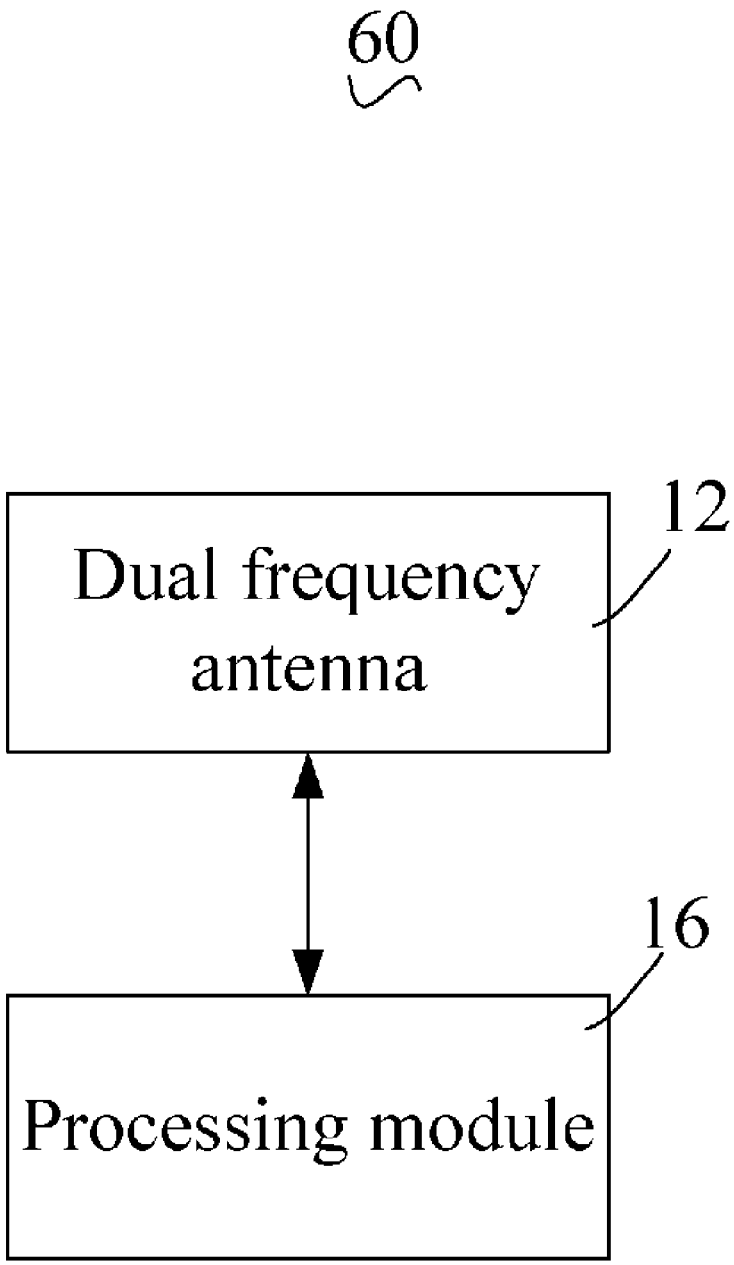
FIG. 1 is a schematic diagram showing a communication system including a dual frequency antenna in accordance with an exemplary embodiment.

Referring to FIG. 1, a communication system 60 in accordance with an exemplary embodiment is adapted to be used in electronic products, such as computers, printers, digital cameras, etc. The communication system 60 includes a dual frequency antenna 12 and a processing module 16. The dual frequency antenna 12 is configured for operating in a first band for Bluetooth® system and a second band for global positioning system (GPS). The processing module 16 is configured for receiving signals from the dual frequency antenna 12, processing the signals and sending processed signals to other successive components, such as a memory (not shown), of the communication system 60.

Figure 2:
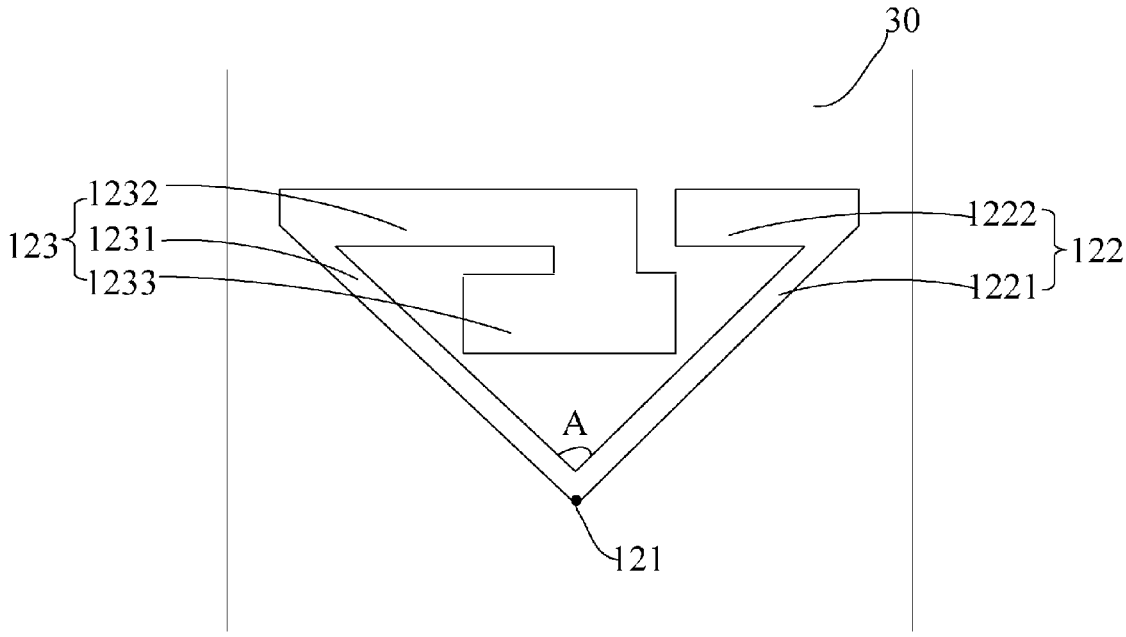
FIG. 2 is a schematic diagram showing a structure of the dual frequency antenna.

Referring to FIG. 2, the dual frequency antenna 12 is disposed on a supporting board 30 that in practice may be a printed circuit board. In the embodiment, the dual frequency antenna 12 is shown just with its radiating portion, other portions such as a grounding plate, a shorting pin, etc., are not shown because they are well known.

The dual frequency antenna 12 includes a first arm 122 operating in the first band, and a second arm 123 operating in the second band. The first arm 122 includes a first primary strip 1221 and a first bent strip 1222. The first primary strip 1221 and the first bent strip 1222 form a first scythe-shaped structure. The first bent strip 1222 is the blade of the scythe.

The second arm 123 includes a second primary strip 1231, a second bent strip 1232, and an inverted-T-shaped strip 1233. The second primary strip 1231 and the second bent strip 1232 form a second scythe-shaped structure. The second bent strip 1232 is the blade of the scythe and the inverted T-shaped strip 1233 is attached to the tip of the blade. The end of the first primary strip 1221 away from the first bent strip 1222 and the end of the second primary strip 1231 away from the second bent strip 1232 are attached to each other forming an apex 121. The first primary strip 1221 and the second primary strip 1231 form two adjacent sides of a triangle and the first bent strip 1222 and the second bent strip 1232 forms the third side of the triangle. The inverted T-shaped strip 1233 is on the inside of the triangle and a space is between the first bent strip 1222 and the second bent strip 1232. The apex 121 of the triangle faces the space.

The first arm 122 and the second arm 123 are made of metal. The first arm 122 and the second arm 123 are connected to the shorting pin (not shown) of the dual frequency antenna 12. The first primary strip 1221 and the second primary strip 1231 form an angle A at the apex 121. The angle A, at the apex 121, is within a range of 40-50 degrees in this embodiment. The second bent strip 1232 is longer than the first bent strip 1222. A foot of the inverted-T-shaped strip 1233 is connected to the second bent strip 1232 and a head of the inverted-T-shaped strip 1233 is parallel to the first bent strip 1222 and the second bent strip 1232. The head is closer to the apex than the foot.

Figure 3:
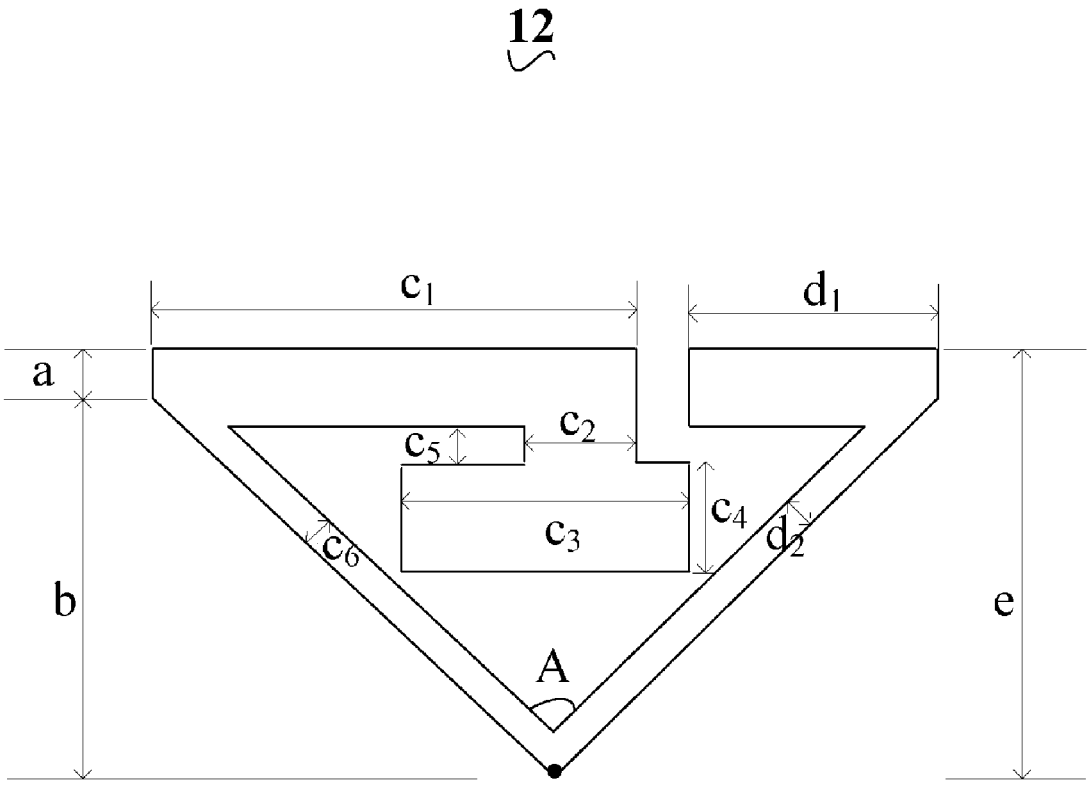
FIG. 3 is a schematic diagram showing dimensions of the dual frequency antenna.

Also referring to FIG. 3, detailed dimensional parameters are illustrated as an example to the dual frequency antenna 12. The angle A is 45 degrees. Exemplary values of dimensions "a, b, c1-c6, d1-d2, e" labeled to the dual frequency antenna 12 are: a=1.3934 mm, b=10.6066 mm, c1=13.1066 mm, c2=3.6998 mm, c3=7.5500 mm, c4=2.9375 mm, c5=0.9853 mm, c6=0.50000 mm, d1=7.0000 mm, d2=0.5000 mm, e=12.0000 mm.

Figure 4:
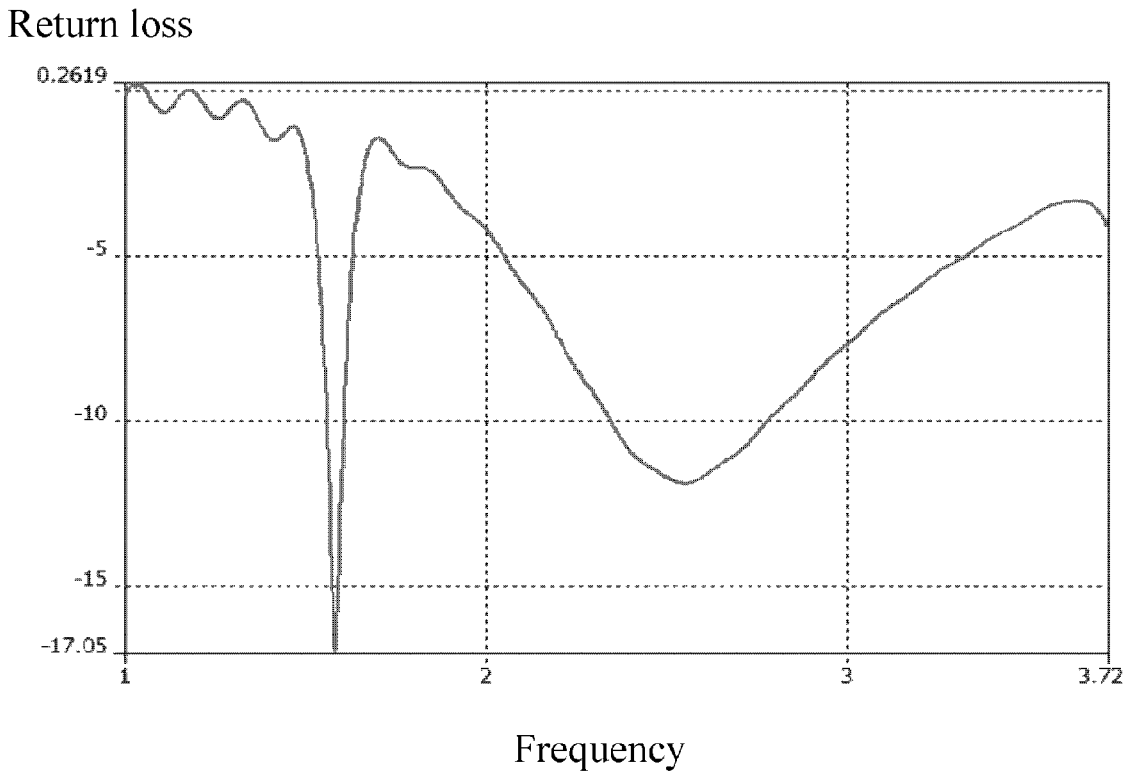
FIG. 4 is a diagram showing return loss of the dual frequency antenna.

Also referring to FIG. 4, measured data of return loss for the dual frequency antenna 12 is illustrated. The resonant frequencies of the dual frequency antenna 12 are 1.575 GHz and 2.45 GHz. The return losses of the resonant frequencies are lower than −10 dB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual frequency antenna comprising:

a first arm operating in a first band, the first arm having a first scythe-shaped structure; and a second arm operating in a second band, the second arm having a second scythe-shaped structure and an inverted-T-shaped strip with a foot connected to an end of the second scythe-shaped structure, the second scythe-shaped structure attached to the first scythe-shaped structure at an apex;

wherein a head of the inverted-T-shaped strip is closer to the apex than the foot and an angle is defined by the first scythe-shaped structure and the second scythe-shaped structure at the apex.

2. The dual frequency antenna according to claim 1, wherein the angle is within a range of 40-50 degrees.

3. The dual frequency antenna according to claim 2, wherein the angle is 45 degrees.

4. The dual frequency antenna according to claim 1, wherein the first arm comprises a first primary strip extending from the apex, and a first bent strip bent from the first primary strip.

5. The dual frequency antenna according to claim 4, wherein the second arm further comprises a second primary strip extending from the apex, and a second bent strip bent from the second primary strip.

6. The dual frequency antenna according to claim 5, wherein the first bent strip and the second bent strip extend toward each other.

7. The dual frequency antenna according to claim 6, wherein the head of the inverted-T-shaped strip is parallel to the first bent strip and the second bent strip.

8. The dual frequency antenna according to claim 5, wherein the first primary strip and the second primary strip intersect at the angle.

9. The dual frequency antenna according to claim 1, wherein the first arm and the second arm are made of metal.

10. A dual frequency antenna comprising:

a first arm operating in a first band, and comprising a first scythe-shaped structure; and a second arm operating in a second band, and comprising a second scythe-shaped structure and an inverted-T-shaped strip, the first scythe-shaped structure and the second scythe-shaped structure extending from an apex and defining a triangle;

wherein the inverted-T-shaped strip is inside the triangle, and a foot of the inverted-T-shaped strip is connected to the second scythe-shaped structure.

11. The dual frequency antenna according to claim 10, wherein the first arm comprises a first primary strip extending from the apex, and a first bent strip bent from the first primary strip, and the first primary strip and the first bent strip form the first scythe-shaped structure.

12. The dual frequency antenna according to claim 11, wherein the second arm further comprises a second primary strip extending from the apex, and a second bent strip bent from the second primary strip, and the second primary strip and the second bent strip form the second scythe-shaped structure.

13. The dual frequency antenna according to claim 12, wherein the first bent strip and the second bent strip are aligned on a same line as a side of the triangle and define a space therebetween.

14. The dual frequency antenna according to claim 12, wherein the first primary strip and the second primary strip form an angle at the apex, and the angle is within a range of 40-50 degrees.

15. A communication system comprising:

a dual frequency antenna for operating in a first band and a second band different from the first band, the dual frequency antenna comprising:

a first arm operating in a first band, and comprising a first scythe-shaped structure; and a second arm operating in a second band, and comprising a second scythe-shaped structure and an inverted-T-shaped strip with a foot connected to the second sick-shaped structure, the second scythe-shaped structure attached to the first scythe-shaped structure at an apex;

wherein a head of the inverted-T-shaped strip is closer to the apex than the foot and an angle is defined by the first scythe-shaped structure and the second scythe-shaped structure at the apex; and a processing module receiving signals from the dual frequency antenna and processing the signals.

16. The communication system according to claim 15, wherein the angle is within a range of 40-50 degrees.

17. The communication system according to claim 16, wherein the angle is 45 degrees.

18. The communication system according to claim 15, wherein the first arm comprises a first primary strip extending from the apex, and a first bent strip bent from the first primary strip.

19. The communication system according to claim 18, wherein the second arm further comprises a second primary strip extending from the apex, and a second bent strip bent from the second primary strip.

20. The communication system according to claim 19, wherein the first bent strip and the second bent strip extend toward each other.

* * * * *